US005718100A

United States Patent [19]

Petty

[11] Patent Number: 5,718,100

[45] Date of Patent: Feb. 17, 1998

[54] PACKAGE WRAPPING APPARATUS AND METHOD

[76] Inventor: Roy L. Petty, 148 Rio Vista Pl., Santa Fe, N. Mex. 87501

[21] Appl. No.: 700,881

[22] Filed: Aug. 21, 1996

[51] Int. Cl.[6] ..... B65B 11/00; B65B 67/08

[52] U.S. Cl. ..... 53/399; 53/582; 53/585; 53/592; 53/390; 242/379.2; 206/457; 229/923

[58] Field of Search ..... 242/379, 379.2, 242/371; 206/457; 229/922, 923; 53/390, 399, 176, 582, 585, 592

[56] References Cited

U.S. PATENT DOCUMENTS

| | | | |
|---|---|---|---|
| 533,276 | 1/1895 | Crone | 242/371 X |
| 1,714,688 | 5/1929 | Mikkelsen . | |
| 2,708,403 | 2/1955 | James . | |
| 3,095,967 | 7/1963 | Harvey | 206/457 |
| 3,198,300 | 8/1965 | Tuttle | 242/379 X |
| 3,315,642 | 4/1967 | Rogers et al. | 242/379.2 |
| 3,370,779 | 2/1968 | Cole | 229/923 X |
| 4,186,833 | 2/1980 | Homan | 206/225 |
| 4,293,601 | 10/1981 | Cole | 428/24 |
| 4,846,248 | 7/1989 | Sonderby | 242/379.2 |
| 4,910,944 | 3/1990 | Segalowitz et al. | 53/582 X |
| 5,219,071 | 6/1993 | Knapp | 206/6.1 |
| 5,392,983 | 2/1995 | Clarke-Bolling et al. | 229/87.19 |
| 5,490,597 | 2/1996 | Schluger | 206/575 |

*Primary Examiner*—Linda Johnson
*Attorney, Agent, or Firm*—Jeffrey D. Myers; Deborah A. Peacock; Donovan F. Duggan

[57] ABSTRACT

A reusable package wrapping apparatus and method. The apparatus has a spring-loaded ribbon reel which dispenses an inverted ribbon in a first direction and recovers the ribbon, which has been re-inverted in a secondly direction. Spring tension or a locked hand crank secures the apparatus to the package.

21 Claims, 3 Drawing Sheets

PACKAGE WRAPPING APPARATUS AND METHOD

BACKGROUND OF THE INVENTION

1. Field of the Invention (Technical Fields)

The present invention relates to reusable apparatus for packaging gifts and the like, and a method for using the apparatus.

2. Background Art

The cost of materials for wrapping gifts and other packaged items is significant. Even though wrapping materials can, to some extent, be salvaged and re-used, ultimately such wrapping materials require replacement.

U.S. Pat. No. 5,490,597, to Schluger, entitled *Gift Packaging and Wrapping Ensemble,* discloses a mailing box for a gift-wrapping kit. The kit comprises, inter alia, stretch ribbon, a gift box, wrapping paper and the like. Manual wrapping of the gift is still required, however.

U.S. Pat. No. 5,392,983, to Clarke-Bolling et al., entitled *Reusable Gift Wrap,* discloses a reusable, washable gift wrapping which includes resealable adhesive. The ribbon or ribbons, however, must be manually emplaced.

U.S. Pat. No. 5,367,752, to Petty, entitled *Expandable Wrapping Ribbon,* discloses a ribbon device for which an expandable portion is hidden by a sheath. The present invention does not employ elasticity to simplify the wrapping process.

U.S. Pat. No. 5,219,071, to Knapp, entitled *Jewelry Package,* discloses a jewelry packaging device for both enclosing and displaying the jewelry. The ribbon both secures the jewelry and secures the closed package. All of these operations require some manual dexterity.

U.S. Pat. No. 4,293,601, to Cole, entitled *Flower-Like Decorative Ornament,* discloses a decorative ornament with elasticized retaining cord wrapped about the package. Although such ornament is reusable, it requires manual placement upon the package.

U.S. Pat. No. 4,186,833, to Homan, entitled *Gift Wrapping Storage Container,* discloses a container for storing ribbons; paper and cards. No package wrapping capability is disclosed.

U.S. Pat. No. 2,780,403, to James, entitled *Package Bow-Guard* discloses a structure for protecting package bows. Again, no wrapping function is disclosed.

Perhaps most relevant is U.S. Pat. No. 1,714,688, to Mikkelsen, entitled *Wrapper for Photographs and the Like.* Mikkelsen discloses slots in packaging plates which function to alter the direction of an elastic band securing the packaging plates and article to be packaged together.

None of the above-cited prior art discloses or suggests a packaging apparatus for dispensing a continuous reusable packaging ribbon.

SUMMARY OF THE INVENTION (DISCLOSURE OF THE INVENTION)

The present invention is of a method and apparatus for wrapping a package comprising: loading a ribbon reel; inverting while changing the direction of a ribbon unwinding from the ribbon reel; and again inverting while changing the direction of the ribbon prior to returning to the housing and anchoring. In the preferred embodiment, the ribbon reel is mounted on a center post. Inverting while changing the direction of the ribbon comprises extending the ribbon in a first direction about a package, and inverting while changing the direction of the ribbon comprises extending the ribbon in a second direction about the package. Inverting (and again inverting) while changing the direction of the ribbon comprises singly or doubly inverting the ribbon. A housing is preferably provided for the ribbon reel and the center post, and the housing, ribbon reel and center post are retained on a package by spring-tension alone (via a spring-loaded ribbon reel or a lockable hand crank).

The invention is also of an apparatus for wrapping a package comprising: a slotted housing; a center post within the housing; a spool having a top flange and a bottom flange mounted within the housing and bearing coiled ribbon mounted upon the center post; a first inverter in the housing for inverting the ribbon prior to egress of the ribbon in a first direction through a first slot in the housing; a second slot in the housing for providing ingress of the ribbon; a second inverter for inverting the ribbon prior to egress of the ribbon in a second direction through a third slot in the housing; and a fourth slot in the housing for providing ingress of the ribbon.

A primary object of the invention is the provision of a continuous-ribbon packaging apparatus.

Another object of the invention is the provision of a reusable packaging apparatus.

Still another object of the invention is the provision of packaging apparatus requiring little manual dexterity.

Yet another object of the invention is the provision of packaging apparatus that can accommodate various package sizes and configurations.

A primary advantage of the present invention is its ease of manufacture.

Another advantage of the invention is its provision of apparatus for ribbon inversion.

Still another advantage of the invention is its provision of apparatus for changing ribbon direction.

Yet another advantage of the invention is the provision of a spool housing which itself may be decorative.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 2(*b*) is a top view as in FIG. 2(*a*) with a hand crank replacing the spring.

FIG. 4(*b*) is a bottom view of the housing;

FIG. 5(*b*) is a perspective view of an inverter providing double ribbon inversion; and FIG. 5(*c*) is an end view of the rounded bar of an inverter of the invention.

DESCRIPTION OF THE PREFERRED EMBODIMENTS (BEST MODES FOR CARRYING OUT THE INVENTION)

Figure 1:
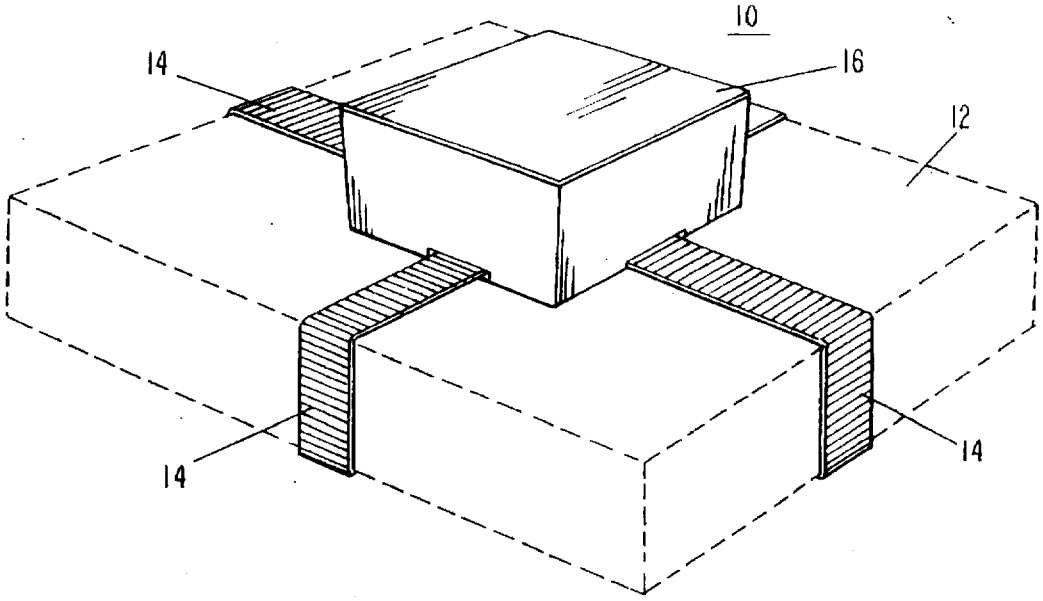
FIG. 1 is a perspective view of the preferred embodiment of the invention mounted upon a package.

The preferred embodiment of the invention is illustrated in FIG. 1. Package wrapping apparatus 16, with continuous ribbon 14 emanating therefrom, is directly mounted on package 12. Both package 12 and package wrapping apparatus 16 may be individually wrapped or otherwise decorated; package wrapping apparatus 16 may also bear printed matter (e.g., advertising logos and mottoes) thereon.

Continuous ribbon 14 is afforded ingress and egress to package wrapping apparatus 16 through slots therein (not shown). Package wrapping apparatus 16 is retained upon package 12 solely by tension in continuous ribbon 14. Package wrapping apparatus 16 may be positioned upon either side of package 12. Further, package wrapping apparatus 16 may itself be positioned in any desired relative configuration on package 12, including but not limited to upright or inverted positions.

Figure 2A:
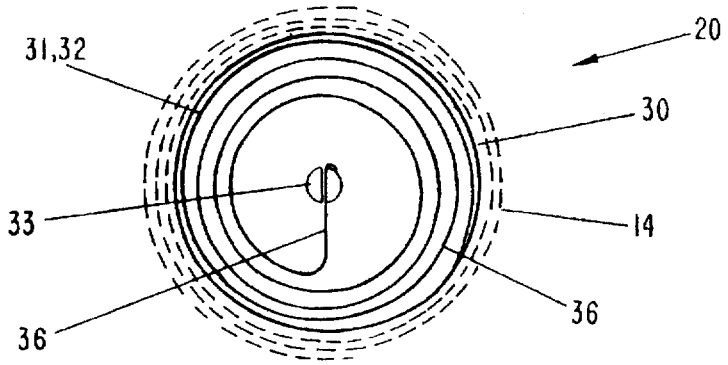
FIG. 2(*a*) is a top view (with top flange removed) of the ribbon dispensing structure of the invention.
Figure 2B:
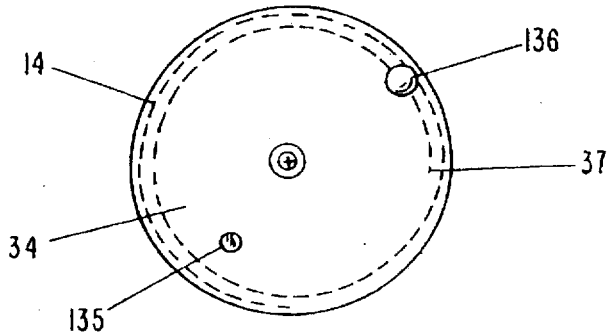

FIGS. 2(*a*) and 3 depict the preferred ribbon dispensing structure 20 of package wrapping apparatus 16. Ribbon dispensing structure 20 comprises spool 30 having a top and bottom flange 31, 32, respectively, and center post 33. Mounted about center post 33 in radially outermost concentric configuration is annularly wound ribbon 14. Next proceeding radially inwardly, is annular ribbon reel 34, supporting ribbon 14. Spring 36 concentrically, radially innermost, is wound about and attached at one end at 37 to ribbon reel 34. The other end of spring 36 is staked, as shown, or otherwise attached to center post 33. Spring 36 may have other configurations, including but not limited to flat springs and coil springs. If desired, spring 36 may be replaced by a simple hand crank 136, as illustrated in FIG. 2(*b*), with locking means 135. Such dispensing structures are conventional in other arts.

Ribbon 14 may be of any desired size, color or configuration consistent with mounting within a given package wrapping apparatus 16. (As used herein and in the claims, "ribbon" includes but is not limited to any coilable strip, ribbon, tape, string, filament, cord or cordage suitable for wrapping packages.)

Figure 3:
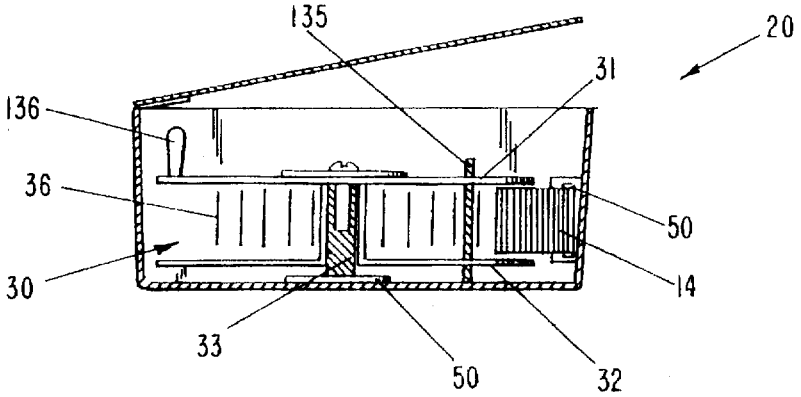
FIG. 3 is a cross-section of the ribbon dispensing structure of the invention.
Figure 4A:
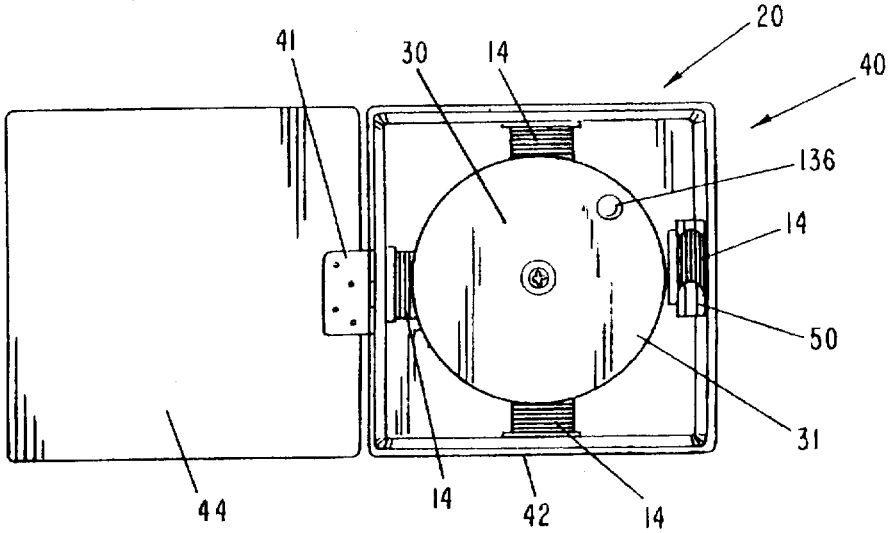
FIG. 4(*a*) is a top view of the housing with cover open.
Figure 4B:
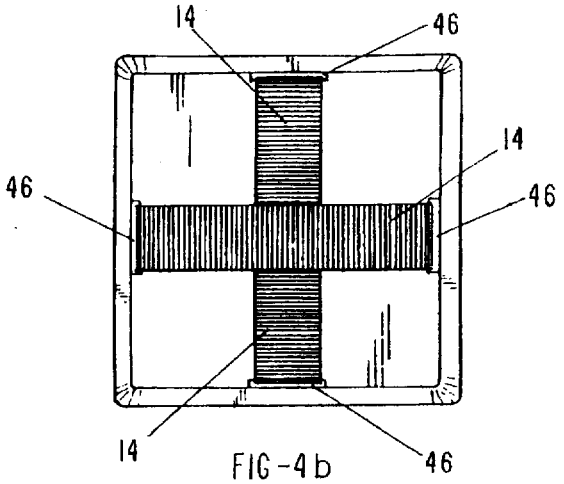

Spool 30 preferably comprises any known plastics composition, but other materials, Such as metal spools, may be employed. As shown in FIGS. 3 and 4(*a*), bottom flange 32 of spool 30 mounts ribbon inverters 50, which perform two essential functions: Inverters 50 provide a 90° change of direction for ribbon 14, while inverting (turning over) ribbon 14. These functions are necessary to provide a flat, neat right angle intersection of ribbon 14 with itself on the underside of package 12.

FIG. 4(*a*) shows the preferred ribbon dispensing housing 40 of the invention. Preferably composed of any known plastic, housing 40 is hinged at 41 to cover main housing portion 42 and the ribbon dispensing structure 30 with cover 44. Hinge 41 and ribbon dispensing structure 30 may be structurally integral with main housing portion 42 or may comprise adhesive tape and the like.

As shown in FIG. 4(*b*), slots 46 provide ingress and egress for ribbon 14. Slots 46 may be positioned at the top or bottom of housing 42, as desired. Housing 42 may be of any desired configuration, for example, circular, square or rectangular; the governing consideration is that of adequately housing ribbon dispensing structure 30.

Figure 5A:
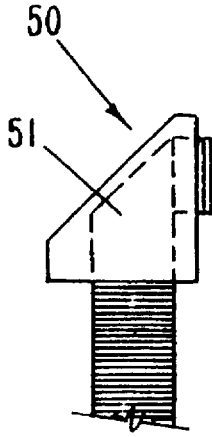
FIG. 5(*a*) is a perspective view of an inverter providing single ribbon inversion.
Figure 5B:
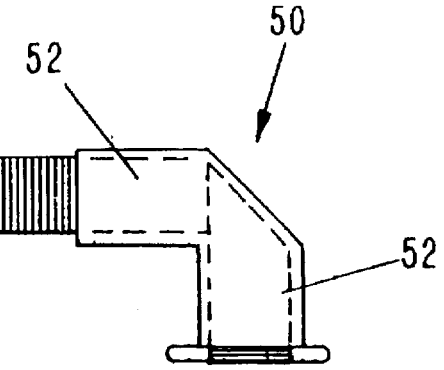
Figure 5C:
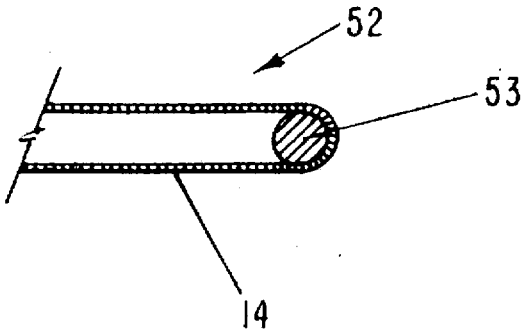

FIGS. 5(*a*) and 5(*b*) show alternative embodiments of ribbon inverter 50 which may be used with the invention. Inverter 51, shown in FIG. 5(*a*), is preferably used with ribbons 14 which are identical in color and design on both sides thereof. Since ribbon 14 must intersect with itself at a right angle and return to the box and anchor, two simple inverters 51 providing single ribbon inversion, such as shown in FIG. 5(*a*), are sufficient for ribbons of identical color and design on each side. Inversion of these ribbons present no perceived differences in appearance on the package.

On the other hand, ribbons unlike on each side in color, design or other characteristics, require an additional inversion to present a uniform appearance on the package. The inverter 52 of FIG. 5(*b*) and 5(*c*) achieves a double inversion by providing a rounded bar 53 for enabling a 180° inversion of the ribbon, accomplished by winding the ribbon about the bar 53 and thereby also turning the ribbon over. Preferably, both types of inverters are channeled to provide jam-proof passage of ribbon 14.

Other ribbon inverter structures may occur to those ordinarily skilled in the art. Again, the two governing characteristics of any ribbon inverter used with the invention are that it will invert the ribbon and provide a 90° change of direction for the ribbon.

In use, continuous ribbon 14 is extended outwardly through slots 46, forming two bights of ribbon strands intersecting at a 90° angle with each other. Package 12 is inserted into the bights; spring-loaded ribbon reel 34 then tensions the ribbon strands about package 12. Apparatus 16 is thereby retained on package 12 by spring tensions alone. In the hand-crank embodiment, the locking mechanism 35 provides the necessary tension.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method for wrapping a package comprising the steps of:

a) loading a single ribbon reel within a housing;

b) extending a ribbon outwardly from the housing;

c) inverting while changing direction of the ribbon unwinding from the ribbon reel;

d) again inverting while changing direction of the ribbon prior to returning to the housing and anchoring;

e) inserting a package within the ribbon bights formed by the inverting; and f) returning the ribbon to the housing and anchoring the ribbon in the housing thereby retaining the housing and ribbon reel on the package.

2. The method of claim 1 further comprising the step of mounting the ribbon reel upon a center post.

3. The method of claim 1 wherein the step of inverting while changing the direction of a ribbon comprises the step of extending the ribbon in a first direction about a package.

4. The method of claim 3 wherein the step of again inverting while changing the direction of the ribbon comprises the step of extending the ribbon in a second direction about the package.

5. The method of claim 1 wherein the step of inverting while changing the direction of a ribbon comprises the step of singly inverting the ribbon.

6. The method of claim 1 wherein the step of inverting while changing the direction of a ribbon comprises the step of doubly inverting the ribbon.

7. The method of claim 1 wherein the step of again inverting while changing the direction of the ribbon comprises the step of singly inverting the ribbon.

8. The method of claim 1 wherein the step of again inverting while changing the direction of the ribbon comprises the step of doubly inverting the ribbon.

9. The method of claim 2 further comprising the step of retaining the housing, ribbon reel and center post upon a package by spring-tension alone.

10. The method of claim 1 wherein the step of loading a ribbon reel comprises the step of spring-loading a ribbon reel.

11. The method of claim 1 additionally comprising the step of providing to the ribbon reel a lockable hand crank.

12. An apparatus for wrapping a package comprising:

a single ribbon reel loaded within a housing;

means for extending a ribbon outwardly from said housing;

a first inverter for inverting and changing direction of said ribbon unwinding from said ribbon reel;

a second inverter for again inverting and changing direction of said ribbon prior to returning to said housing and anchoring; and means for returning said ribbon to said housing and anchoring said ribbon in said housing thereby retaining said housing and ribbon reel on a package placed within bights formed by said ribbon.

13. The apparatus of claim 12 further comprising a center post on which said reel is mounted.

14. The apparatus of claim 12 wherein said first inverter comprises means for singly inverting said ribbon.

15. The apparatus of claim 12 wherein said first inverter comprises means for doubly inverting said ribbon.

16. The apparatus of claim 12 wherein said second inverter comprises means for singly inverting said ribbon.

17. The apparatus of claim 12 wherein said second inverter comprises means for doubly inverting said ribbon.

18. The apparatus of claim 12 wherein said extending and returning means comprise housing slots for egress and ingress of said ribbon.

19. The apparatus of claim 13 wherein said ribbon reel comprises a spring-loaded ribbon reel.

20. The apparatus of claim 12 wherein said ribbon reel comprises a lockable hand crank.

21. An apparatus for wrapping a package comprising:

a housing;

a center post within said housing;

a single spool having a top flange and a bottom flange mounted within said housing and bearing coiled ribbon mounted upon said center post;

a first slot in said housing for providing egress of said ribbon from said housing;

a first inverter in said housing for inverting said ribbon prior to egress of said ribbon from said housing in a first direction through said first slot;

a second slot in said housing for providing ingress of said ribbon into said housing;

a third slot in said housing for providing egress of said ribbon from said housing;

a second inverter for inverting said ribbon prior to egress of said ribbon from said housing in a second direction through said third slot; and a fourth slot in said housing for providing ingress of said ribbon into said housing.

* * * * *